US007093992B2

(12) United States Patent
Zeller et al.

(10) Patent No.: US 7,093,992 B2
(45) Date of Patent: Aug. 22, 2006

(54) VERSATILE COLLATOR AND SYSTEM INCORPORATING SAME

(75) Inventors: Sarah E Zeller, Boise, ID (US); Michael Lloyd, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/659,866

(22) Filed: Sep. 10, 2003

(65) Prior Publication Data

US 2005/0053404 A1 Mar. 10, 2005

(51) Int. Cl.
*B41J 13/10* (2006.01)

(52) U.S. Cl. ..... 400/647.1; 400/646; 400/647; 270/58.19; 271/223; 399/405

(58) Field of Classification Search ..... 400/646, 400/647, 647.1; 270/58.18, 58.19; 271/171, 271/223; 399/405
See application file for complete search history.

(56) References Cited

U.S. PATENT DOCUMENTS

| | | | | |
|---|---|---|---|---|
| 2,260,540 | A * | 10/1941 | Schramm | 270/59 |
| 2,589,676 | A * | 3/1952 | Crissy | 271/11 |
| 3,851,872 | A | 12/1974 | Gerbasl | |
| 3,907,279 | A * | 9/1975 | Ervin | 271/293 |
| 4,332,377 | A * | 6/1982 | DuBois et al. | 271/293 |
| 4,398,712 | A * | 8/1983 | George | 271/293 |
| 4,473,223 | A * | 9/1984 | Lap | 271/294 |
| 4,772,009 | A | 9/1988 | Jacobs | |
| 4,780,740 | A * | 10/1988 | Fukae | 399/86 |
| 5,033,731 | A * | 7/1991 | Looney | 271/176 |
| 5,035,412 | A * | 7/1991 | Hiroi et al. | 270/58.19 |
| 5,240,245 | A * | 8/1993 | Ademmer et al. | 271/279 |
| 5,551,680 | A * | 9/1996 | Ohmichi et al. | 270/58.08 |
| 5,898,592 | A * | 4/1999 | Salgado et al. | 700/214 |
| 6,041,214 | A * | 3/2000 | Fujikura et al. | 399/403 |
| 6,168,145 | B1 * | 1/2001 | Tanaka et al. | 270/58.11 |
| 6,170,821 | B1 * | 1/2001 | Kubota | 271/288 |

FOREIGN PATENT DOCUMENTS

| | | |
|---|---|---|
| EP | 0412967 | 3/1995 |

* cited by examiner

*Primary Examiner*—Leslie J. Evanisko
*Assistant Examiner*—Jill E. Culler

(57) ABSTRACT

An efficient collator. The collator includes a first mechanism for selectively separating physical output from a device. A second mechanism is coupled to the first mechanism and facilitates angling and/or rotating the first mechanism based on the physical output. In a specific embodiment, the second mechanism includes a controller that generates control signals to control the second mechanism to facilitate automatic positioning of the first mechanism about a curved track.

26 Claims, 4 Drawing Sheets

VERSATILE COLLATOR AND SYSTEM INCORPORATING SAME

BACKGROUND OF THE INVENTION

1. Field of Invention

This invention relates to systems and methods for organizing output. Specifically, the present invention relates to collators for organizing output, such as printer output.

2. Description of the Related Art

Printers are employed in various demanding applications including mass printing, document publishing, and so on. Such applications often demand specialized mechanisms for organizing printed output, such as print job separators and sorters or collators.

In many printing systems, documents are output to a single output tray. A user then manually sorts or separates printer output by printer job or other criteria. Unfortunately, manual print job separation and output sorting is undesirably tedious for many applications.

To facilitate printer output organization, rear-mounted collators with accompanying print media flippers may be employed. In an exemplary laser printing system with a rear-mounted collator, print media, such as paper, often exits the printer fuser near the top front of the printer and then passes toward the back of the printer. In these systems with rear-mounted collators, print media output from the fuser is then flipped and fed to a collator. The media flipper ensures that the output print media appears properly oriented in the output bins associated with the collator. Unfortunately, media flippers are often expensive, and the rear-mounted collators are often undesirably bulky and lack customizability. In addition, paper trays of rear mounted collators often do not efficiently accommodate lengthy print media, such as legal documents, and may interfere with user-access to printer access doors positioned below the print media output bins.

Alternatively, front-mounted collators are employed. Print media output bins associated with these collators often face toward the rear of the printer to minimize space occupied by the printer. However, the collator blocks user-access to the printer output from the front of the printer, and consequently, printer output must be accessed from the side or rear of the printer, which is less user friendly. For example, to facilitate user-access to the printer output, the printer may require sideways or backward positioning, which is undesirable for certain applications.

Hence, a need exists in the art for an efficient system and method for organizing printer output that facilitates user-access to the printer output and that neither requires a media flipper nor requires sideways or backward printer orientation. There exists a further need for a system that can efficiently organize printer output; efficiently accommodate print media of differing lengths; and allow easy access to printer access doors.

SUMMARY OF THE INVENTION

The need in the art is addressed by a collator constructed in accordance with the teachings of the present invention. In the illustrative embodiment, the inventive collator is adapted for use with printers. The collator includes a first mechanism for selectively automatically separating printer output. A second mechanism, which is coupled to the first mechanism, facilitates angling and/or rotating the first mechanism based on the printer output.

In a specific embodiment, the second mechanism includes a controller that generates control signals to control the second mechanism to facilitate automatic positioning of the first mechanism. The second mechanism includes a curved track in communication with one or more output trays. Movement of the curved track and positions of the output trays on the curved track are selectively controlled by a motor via the control signals. The second mechanism includes adjustable paper guides for facilitating directing the printer output into an output tray.

In the specific embodiment, the second mechanism includes a paper level sensor that communicates with the controller. The third mechanism generates a control signal to the motor to position a different output tray in a printer output path when the paper level sensor indicates that the current output tray is full. The output trays are positioned approximately perpendicular to the curved track and are rotatable about an axis of the track. The curved track enables the output trays to be sufficiently rotated to expose printer access doors or other printer features or to enable users to retrieve media manually before sorting by the collator.

The novel design of the specific embodiment of the present invention is facilitated by the second mechanism, which employs the nonlinear, curved track, to selectively move output trays into and out of position to separate print jobs and to accommodate filled output trays. Employing the curved track and allowing the trays to move along the curved track or with the curved track, results in space-efficient collators that can be readily positioned to enable easy access to printer-access doors, printer output media, and to accommodate print media larger than the output trays.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The following review of a printer having a conventional rear-mounted collator is intended to facilitate an understanding of the present invention.

Figure 1:
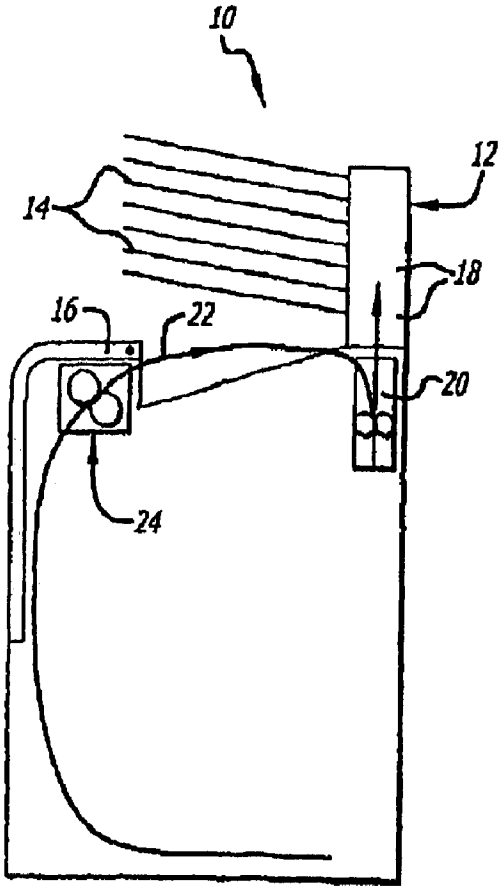
FIG. 1 (PRIOR ART)
FIG. 1 is a simplified diagrammatic side view of a conventional printer with a rear-mounted collator.

FIG. 1 is a simplified diagramatic side view of a conventional printer 10 with a rear-mounted collator 12. The collator 12 has fixed output trays 14 mounted on a collator body 18 and facing toward the front of the printer 10. The output trays 14 may prevent complete opening of a front printer-access door 16 and may obstruct user-access to other access doors (not shown) below the output trays 14. A media flipper 20 is positioned below the collator body 18 in the media path 22. The media path 22 passes through fuser rollers 24 before passing through the media flipper 20.

In operation, print media passes through the fuser rollers 24, where heat and pressure are applied to fuse toner to the print media, the toner being deposited previously via an electrophotographic process. The print media then passes through the media flipper 20, where the print media is flipped to preserve media orientation when the print media passes to the output trays 14. For example, if print media exits the fuser rollers 24 face-down, the media flipper 20 ensures that the print media will enter the output trays 14 face-down. If the media flipper 20 is omitted or replaced by a simple roller, face-down media leaving the fuser rollers 24 would enter the output trays 14 face-up. Similarly, face-up media would switch to face-down in the output trays 14. Consequently, without the media flipper 20, the first page of a document may end up as the last page, and hence, require reordering.

Print media entering the collator body 18 passes through various electronics and/or conveyor systems (not shown) designed to sort the print media into different output trays 14. Print media is often sorted by printer job and/or output tray capacity.

The requisite media flipper 20 and the electronic sorting mechanism (not shown) in the collator body 18 for selectively redirecting print media output from the media flipper 20 into appropriate output trays 14 are relatively complex and expensive. Furthermore, in large printers, the output trays 14 are relatively bulky and may stack to levels that are difficult to reach by hand. In addition, the collator 12 may not adequately handle print media that is longer than the output trays 14.

Figure 2:
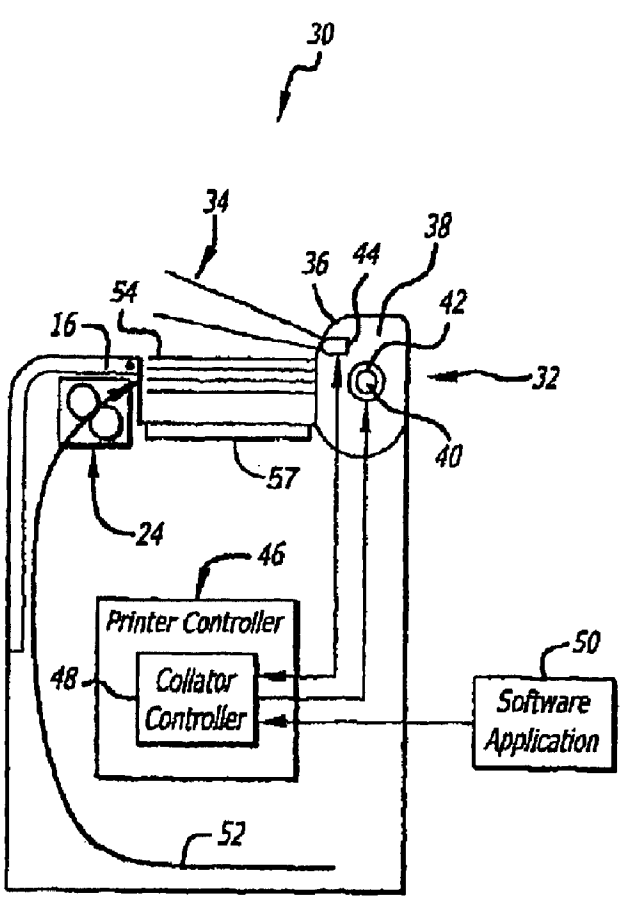
FIG. 2 is a simplified diagrammatic side view of a printer having an accordion-style collator in a partially expanded state according to an illustrative embodiment of the present invention.

FIG. 2 is a simplified diagrammatic side view of a novel printer 30 having an accordion-style collator 32 in a partially expanded state constructed in accordance with the teachings of the present invention. For clarity, various components, such as power supplies, toner cartridges, computers, operating systems, and so on, have been omitted from the figures. However, those skilled in the art with access to the present teachings will know which components to implement and how to implement them to meet the needs of a given application.

The accordion-style collator 32 is equipped with collapsible output trays 34 that are mounted on a curved track 36 that is positioned on or in a curved collator body 38. The curved track 36 may extend about the circumference of the collator body 38. Alternatively, the curved track 36 may extend about a portion of the circumference of the collator body 38 to meet the needs of a given application. The curved track 36 facilitates angling and/or rotating, i.e., nonlinear positioning of the output media trays 34 as discussed more fully below.

The curved track 36 may be implemented in accordance with methods known in the art. For example, curved tracks employed on certain compact disc holders, such as the CD storage rack, part No. SI793, available at The Sharper Image, may be adapted by one skilled in the art to construct the track 36 without undue experimentation.

For the purposes of the present discussion, nonlinear positioning refers to moving the trays 24 to different positions, resulting in the surfaces of the trays 34 being positioned at different angles relative to their initial positions. Examples of nonlinear tray movements include twisting or rotating about a predetermined axis. Linear tray movements include translating the entire tray on one direction or another.

Movement of the curved track 36 and the positions of the output trays 34 on the curved track are controlled by a motor 42, which is shown positioned about a longitudinal axis 40 of the collator body 38. A printer controller 46 runs collator controller software 48. The collator controller software 48 receives input from a software application 50, which may be running on an external computer (not shown). The collator controller software 48 communicates with a print media level sensor 44 that is positioned in the collator body 38 to sense the level of print media in an output tray 54 that is currently being filled. The current output tray 54 is positioned so that an open end of the tray 54 receives print media output from the fuser rollers 24. The collator controller software 48 provides control commands to the collator motor 42, which is geared to selectively move paper trays 34 along or with the curved track 36. In the present specific embodiment, the curved track 36 is designed so that media trays 34 can move independently and are not permanently fixed with respect to each other. However, the media trays 34 can also move in unison. In this case, allowable movement of one tray depends on current positions of other trays 34. Independent tray movement capability is not required in some applications.

For purposes of the present discussion, a printer is any mechanism used to generate a desired image, such as text, on physical output, such as paper, transparencies, and so on. Consequently, fax and copy machines are considered printers for purposes of the present discussion. The collator 32 may be adapted to devices other than printers, such as mail sorters, without departing from the scope of the present invention.

In operation, print media follows an abbreviated print media path 52 that passes through the fuser 24 and any exit and enters the current media tray 54. The media level sensor 44 is positioned in the collator body 38 and monitors the level of print media in the current media tray 54 and provides an appropriate signal to the collator controller 48 when the current media tray 54 is full. The collator controller 48 selectively commands the motor 42 to move the current media tray 54 via the curved track 36 and gearing (not shown) when the current media tray 54 is full, when a new print job is ready for printing, when a different mailbox collator position is selected, or in response to other conditions that necessitate moving the current media tray 54. The current media tray 54 is moved out of position, and a subsequent empty media tray is then positioned, via commands sent to the collator motor 42, to receive print media output from the fuser rollers 24.

The collator controller 48 determines that a new print job is ready via novel methods or via methods known in the art. For example, the printer controller 46 may communicate with or run printer driver software (not shown) that tracks current print jobs and forwards print job status information to the collator controller 48. Similarly, the application software 50, which may include printer driver software, sends data corresponding to a document to be printed to the printer controller 46 for printing. The collator controller 48 determines when the document is finished printing, and actuates the paper trays 34 accordingly.

The bases of the printer trays 34, which are mounted on the curved track 36, move along or with the curved track approximately about the longitudinal axis 42 of the collator body 38. By using the nonlinear curved track 36 rather than a liner track, space is conserved, and enhanced flexibility in tray positioning is achieved. For example, as discussed more fully below, the paper trays 34 may be collapsed down to accommodate print media that is to large or long to fit in the media trays 34 and may be manually or automatically rotated up to facilitate user access to the printer access door 16. In addition, print media in the trays 34 is easily accessed by a user and does not require that the printer 30 be positioned sideways on a desk to facilitate user-access to the printer output. Furthermore, use of the unique collator 32 obviates the need for an expensive media flipper (see 20 FIG. 1) or other media-sorting mechanical mechanisms. In addition, the collator 32 is readily adapted to existing printers without significant physical modification.

Details of mechanisms for implementing tracks that enable independent actuation of objects connected to the track, such as the curved track 36, are known in the art and may be adapted to for the purposes of the present invention without undue experimentation. Furthermore, motors for actuating such tracks in response to controls signals are known in the art and may be adapted for the purposes of the present invention without undue experimentation.

Alternatively, the media trays 34 are rigidly or flexibly attached to the curved track 36, and the entire collator body 38 is selectively rotated by the motor 42 to achieve desired positioning of the media trays 34. Hence, instead of controlling each tray 34 independently, the collator controller 48 selectively rotates the collator body 38 to achieve the desired tray orientation and to effectively sort printer output. Alternatively, only the track 36 is moved, and positions of each tray 34 are not individually controlled, but are controlled collectively via movement of the track 36.

Figure 3:
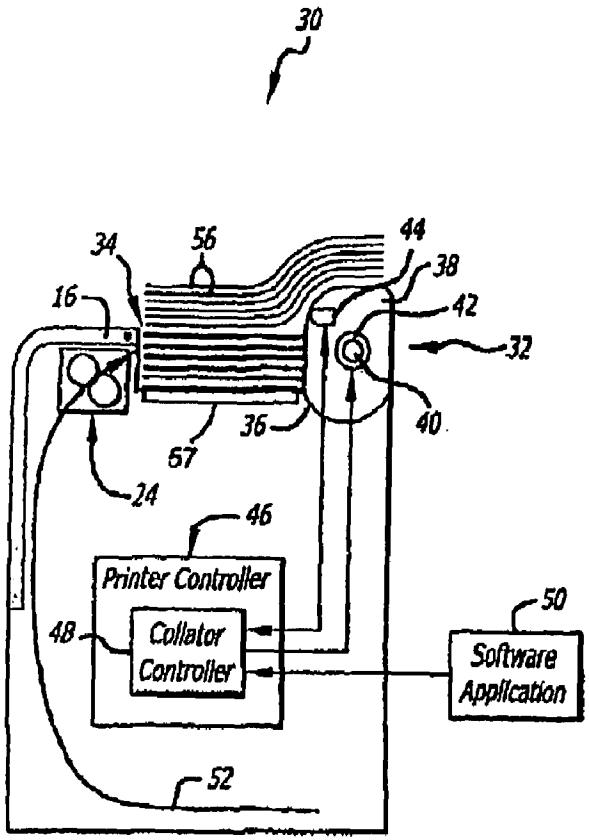
FIG. 3 is a simplified diagrammatic side view of the printer of FIG. 2 with the accordion-style collator in a collapsed state for accommodating extra-long print media.

FIG. 3 is a simplified diagrammatic side view of the printer 30 of FIG. 2 with the accordion-style collator 32 in a collapsed state for accommodating extra-long print media 56. The output media trays 34 are sized so that when they are completely folded down, facing the fuser rollers 24, the lengthy print media 56 may pass over the top of the trays 34. The output media trays 34 may be made collapsible to meet the needs of a particular application to enable the lengthy print media 56 to pass over the output media trays 34. In addition, collapsing of the trays 34 as shown in FIG. 3 may be automatically performed via the collator controller 48 and motor 42 in response to information from the software application 50 indicating that the extra long print media 56 will be printed.

Those skilled in the art with access to the present teachings may readily implement various modules, such as the collator controller 48, printer controller 46, the software application 50, without undue experimentation. Furthermore, these modules may be implemented in hardware, software, and/or firmware. The printer 30, including the collator 32 and accompanying trays 34 may also be implemented by those skilled in the art without undue experimentation.

Figure 4:
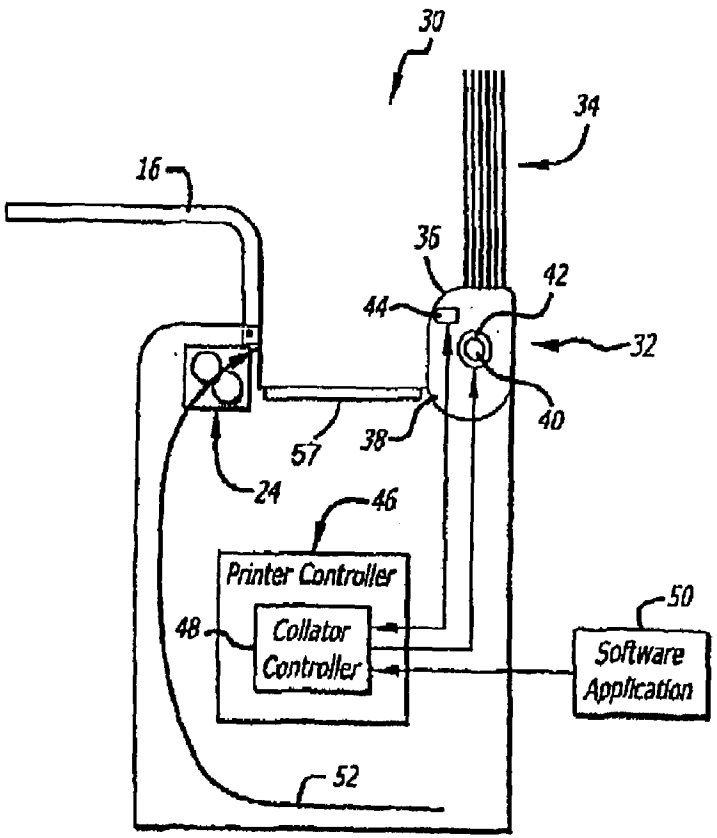
FIG. 4 is a simplified diagrammatic side view of the printer of FIG. 2 with the accordion-style collator in a vertical position to facilitate user-access to printer access doors.

FIG. 4 is a simplified diagrammatic side view of the printer 30 of FIG. 2 with the accordion-style collator 32 in a vertical position to facilitate opening the printer access door 16. The user-access door 16 may enable user-access to various intemal printer components, such as buttons or rollers (not shown) to facilitate clearing paper jams, and so on. In addition, some printer models may include access doors, such as access door 57, positioned on the printer 30 between the fuser rollers 24 and the collator 32. Access to such doors would be enabled by the vertical position of the trays 34.

The output media trays 34 may be positioned vertically as shown in FIG. 4 either manually, via manual override, or automatically. The output media trays 34 may be automatically vertically positioned via the collator controller 48 and motor 42 in response to a control signal generated by driver software or application software 50 in response to predetermined criteria and/or user input.

Furthermore, in certain applications, such as very large print jobs that do not fit within the collator output trays 34, a user may disable the collator 32 by vertically positioning the output trays 34. The vertically positioned output trays 34 enable the user to easily access printer output that bypasses collator output trays 32. This is particularly useful for facilitating small media retrieval, such as retrieval of 3×5 cards, business cards, and so on. Hence, the versatile design of the collator 32 may facilitate selectively disabling the collator 32 or accessing other printer features.

Figure 5:
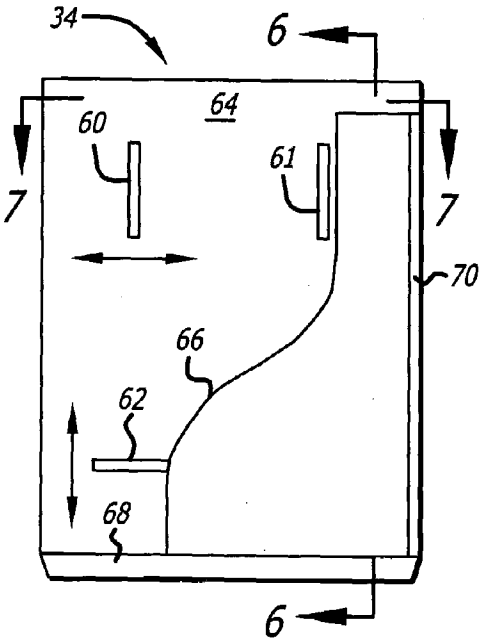
FIG. 5 is a top view of an output tray of the accordion-style collator of FIG. 2.

FIG. 5 is a top view of an output tray 34 of the accordion-style collator 32 of FIGS. 2–4. The output tray 34, which is facing up in FIG. 5, includes adjustable horizontal media guides 60 and 61, which control the horizontal positioning of output print media and ensures that the output print media stacks neatly. The horizontal guides 60, 61 may be adjusted laterally to accommodate different width output media.

An adjustable rear media stop 62 extends horizontally under a top surface 66 of the output media tray 34. The media guides 60, 61 and rear media stop 62 are mounted to a bottom surface 64 and/or a top surface 66 of the output media tray 34. The top surface 66 of the output media tray 34 has a curved cut-away shape to facilitate user-access to print media positioned in the output media tray 34.

The rear media stop 62 may be manually positioned at different longitudinal positions via grooves or other securing-mechanisms (not shown) in the bottom surface 64 and/or top surface 66. Alternatively, automatic positioning of the rear stop 62 may be employed without departing from the scope of the present invention. Various micro-motors and guide tracks (not shown) strategically positioned within the output media tray 34, which communicate with the collator controller 48 of FIGS. 2–4, could be employed to implement an automatic control of the rear stop 62 to accommodate different length print media.

The top surface 66 is partially supported by a side support wall 70 that extends from the bottom surface 64 to the top surface 66 and to a rear tapered section 68. The rear tapered section 68 is designed to fit the curved track 36 of FIGS. 2–4. The vertical height of the output media tray 34 and the extent to which the rear tapered section 68 is tapered, are application-specific and may be determined by one skilled in the art to meet the needs of a given application. Generally, the more gradual and narrow the taper and the thinner the output media tray 34, the more paper trays 34 can be accommodated on the curved track 36 of FIGS. 2–4.

The taper 68 may be omitted without departing from the scope of the present invention. In certain applications, especially those employing thin trays or a collator track (see 36 of FIG. 4) with a gradual curve, the taper 68 is not required.

Figure 6:
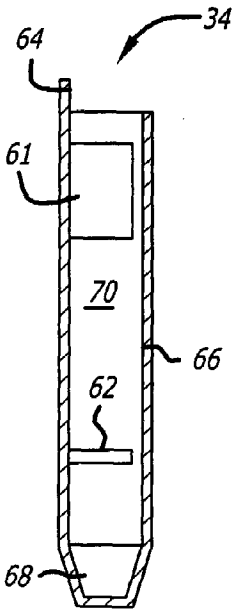
FIG. 6 is a side cross-sectional view of the output tray of FIG. 5.

FIG. 6 is a side cross-sectional view of the output tray of FIG. 5. The entire paper tray 34 may be made collapsible by making the horizontal paper guides 60, 61, the rear stop 62, the tapered section 68, and the support wall 70 from flexible, foldable, or otherwise collapsible material.

Figure 7:
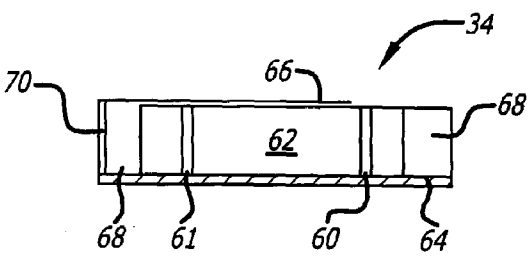
FIG. 7 is a front cross-sectional view of the output tray of FIG. 5 looking into the tray.

FIG. 7 is a front cross-sectional view of the output tray 34 of FIG. 5 looking into the output media tray 34 as seen by incoming print media. View of the tapered section 68 of FIGS. 5–6 is partially obstructed by the rear stop 62.

Figure 8:
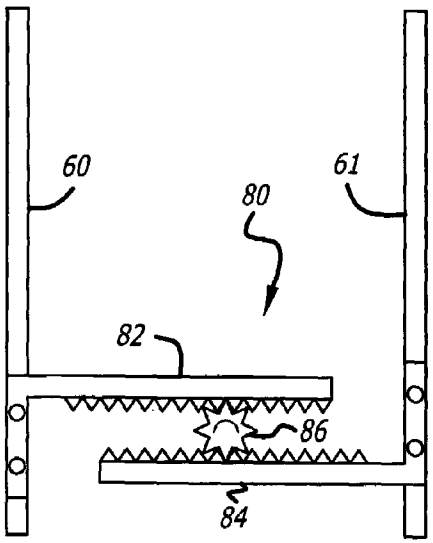
FIG. 8 shows a gear mechanism for positioning side paper guides of the tray of FIG. 5.

FIG. 8 shows a gear mechanism 80 for positioning side paper guides of the tray of FIG. 5. The gear mechanism includes a left saw-toothed beam 82 that is connected to a left paper guide 60 at one end and extends into a space between paper guides 60, 61. The left saw-toothed beam 82 faces downward so that the accompanying teeth face downward. A right saw-toothed beam 84 extends from a right paper guide 61 into the space between paper guides and faces up toward the teeth of the left saw-toothed beam 82. A toothed gear 86 is positioned between the left and right saw-toothed beams 82 and 84. Teeth of the toothed gear 86 ride in the grooves formed by the teeth of the saw-toothed sections 82 and 84.

The various components of the gear mechanism 80 are arranged so that rotation of the toothed gear causes the paper guides 60, 61 to translate horizontally. Similarly, movement of one of the paper guides 60 or 61 causes the other paper guide 61 or 60, respectively, and toothed gear 86 to move accordingly.

The gear mechanism 80 may be driven via a small electric motor (not shown) in each tray 34 of FIG. 2 to enable automatic adjustment of the paper guides 60, 61 to accommodate different media sizes. The small electric motors would be responsive to control signals received by the collator controller 48.

Figure 9:
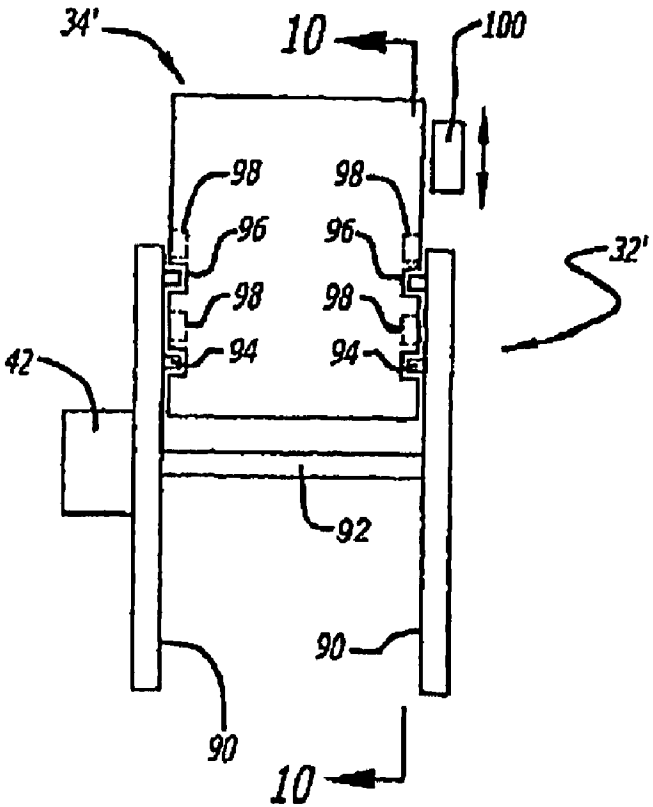
FIG. 9 is a top view of an alternative embodiment of the collator of FIGS. 2–4 adapted to facilitate independent control of paper tray position.

FIG. 9 is a top view of an alternative embodiment 32' of the collator 32 of FIGS. 2–4 adapted to facilitate independent control of paper tray position. The collator 32' includes two rotatable disks 90 that are rigidly connected by a concentric axle 92. The disks 90 are selectively rotated by the motor 42. The disks 90 include inward pointing lifter pins 94, which are adapted for use with special paper trays 34'. The special paper trays 34' have channels 96 through which the lifter pins pass freely when the trays 34' are disengaged from the collator 32'. The special paper trays 34' include notches 98 designed to catch and engage the lifter pins 94 when the trays 34' are inserted into an engaged position via a solenoid 100. The solenoid 100 may be controlled via signals from the controller 48 of FIGS. 2–4 or via manual control.

Alternatively, collator 32' could be implemented with a rack analogous to the Sharper Image CD rack. The solenoid 100 could move the paper trays in and out of tray holders (analogous to the CD holders in the Sharper Image CD rack). Unfilled trays may be selectively loaded into the tray holders upon filling, and the collator 32' may then move the filled tray out of the way. After a top tray is filled, it could be pushed in to a holder and moved out of the way, and may remain in the holder until it is emptied and returned to the initial position.

Figure 10:
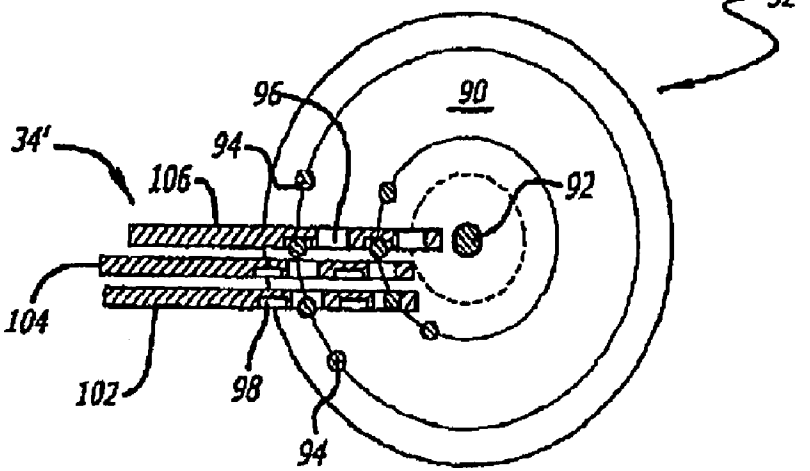
FIG. 10 is a cross-sectional view of the collator of FIG. 9.

FIG. 10 is a cross-sectional view of the collator 32' of FIG. 9. For illustrative purposes, the special trays 34' include a bottom tray 102, a middle tray 104, and a top tray 106. The bottom tray 102 and the middle tray 104 are disengaged from the collator 32', while the top tray 106 is engaged. The top tray 106 will move from its current position when the disks 90 are rotated.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A collator comprising:

first means for selectively separating physical output from a device, the first means including a first output tray and a second output tray; and second means coupled to said first means for angling and/or rotating said first output tray while the second output tray remains stationary and based on said physical output, wherein said collator is a printer collator, and said physical output is printer output and wherein said second means includes means for selectively engaging or disengaging trays included in said first means to selectively move trays into desired positions.

2. The collator of claim 1 wherein said second means includes a controller, said controller including third means for generating control signals to control said second means to facilitate automatic positioning of said first means to selectively separate said physical output.

3. The collator of claim 2 wherein said second means includes a curved surface in communication with the first output tray, said curved surface and positions of said first output tray on said curved surface controllable via a motor, said motor responsive to said control signals.

4. The collator of claim 3 wherein said second means includes adjustable output media guides for facilitating directing said physical output onto an appropriate output tray, and wherein said curved surface is fitted with a curved track having the first output tray positioned thereon.

5. The collator of claim 3 wherein said second means includes an output media level sensor in communication with said controller, said third means generating a control signal to said motor effective to position a different output tray in an output path when said output media level sensor indicates that an output tray currently being filled is full.

6. The collator of claim 5 wherein the first output tray is positioned approximately perpendicular to said curved track and is rotatable about an axis of said track.

7. The collator of claim 6 wherein said curved track is shaped to enable the first output tray to be sufficiently rotated to expose one or more access doors, to expose other printer features, or to selectively disable said collator.

8. A collator comprising:

first means for accommodating output in different positions;

second means for sensing a property associated with said output and providing a signal in response thereto; and third means coupled to said first means for facilitating automatic positioning of said first means in response to said signal to facilitate organization of said output, wherein said first means includes one or more output compartments defined by one or more output trays and wherein said third means includes means for collapsing trays associated with said first means in response to said signal to accommodate print media that is longer than the longest of said trays.

9. The collator of claim 8 wherein said second means includes a controller in communication with software, said software allowing a user to specify a type of output.

10. The collator of claim 9 wherein said third means includes a curved track having said one or more output trays mounted thereon, said curved track accommodating different tray positions.

11. The collator of claim 10 wherein said third means includes a motor in communication with said curved track for selectively actuating one or more of said output trays to one or more of said different tray positions in response to said signal.

12. The collator of claim 11 wherein said second means includes a paper level sensor mounted adjacent to said one or more output trays.

13. The collator of claim 12 wherein said third means includes fourth means for re-directing said output to a different output tray in response to a signal output from said paper level sensor.

14. A collator comprising:

one or more output trays;

a track enabling varying positions of said one or more output trays;

means for selectively positioning said output trays about a longitudinal axis of said track to enable filling of each of said output trays; and means for collapsing said one or more output trays to enable output media to pass over said output trays.

15. The collator of claim 14 further including means for sufficiently rotating said output trays about said longitudinal axis to expose access doors on an accompanying device.

16. The collator of claim 14, wherein one or more of said one or more output trays are fitted with adjustable media guides to accommodate varying widths of output media.

17. The collator of claim 16, wherein said adjustable media guides include a gear mechanism having one or more gears and/or toothed beams to facilitate positioning said media guides.

18. A system for organizing printer output comprising:

a curved track having a first end spaced from a second end;

compartments adapted to accommodate printer output media, wherein the compartments are directly attached to the track and are configured to be independently movable along the track; an actuar configured to selectively engage and disengage the compartments;

a motor in communication with said actuator; and a controller in communication with said motor, said controller generating control signals to said motor to independently control and selectively position said compartments to different positions along the curved track to direct said printer output media into a desired one of said compartments.

19. A printer capable of organizing printer output comprising:

a curved track having a first end spaced from a second end;

first means for generating an image on printer output media compartments adapted to accommodate said printer output media, said compartments attached to the curved track to move along the curved track independent of one another; an actuar configured selectively engage and disengage the compartments;

a motor in communication with said actuator; and a controller in communication with said motor, said controller generating control signals to said motor to independently control and selectively position said compartments to different positions along said curved track to direct said printer output media into a desired one of said compartments.

20. A collator comprising:

a first media divider;

a second media divider;

a first actuator configured to non-linearly move the first divider while the second divider remains stationary; and a second actuator configured to move the first divider between a first position in which the first divider is operably engaged by the first actuator and a second position in which the first divider is operably disengaged from the first actuator.

21. The collator of claim 20, wherein the first actuator is configured to non-linearly move the second divider while the first divider remains stationary.

22. The collator of claim 20, wherein the first divider and the second divider are coupled to a discontinuous curved track.

23. The collator of claim 20 wherein the first divider and the second divider are configured to be collapsed to enable media to pass over the first divider and the second divider.

24. A printer comprising:

a surface; and a collator including:

a first media divider;

a second media divider; and an actuator configured to non-linearly move the first divider and the second divider between a first position in which the first divider and the second divider extend over the surface and a second position in which the first divider and the second divider expose the surface, wherein the first divider and the second divider extend parallel to the surface in the first position and wherein the first divider and the second divider extend perpendicular to the surface in the second position.

25. The printer of claim 24 including an access door providing the surface.

26. A collator comprising:

first means for selectively separating physical output from a device, the first means including a first output tray and a second output tray; and second means coupled to said first means for angling and/or rotating said first output tray while the second output tray remains stationary and based on said physical output, wherein said second means includes a curved surface in communication with the first output tray, said curved surface and positions of said first output tray on said curved surface controllable via a motor, said motor responsive to said control signals, wherein said second means includes a controller, said controller including third means for generating control signals to control said second means to facilitate automatic positioning of said first means to selectively separate said physical output, wherein said second means includes an output media level sensor in communication with said controller, said third means generating a control signal to said motor effective to position a different output tray in an output path when said output media level sensor indicates that an output tray currently being filled is full, wherein the first output tray is positioned approximately perpendicular to said curved track and is rotatable about an axis of said track and wherein said curved track is shaped to enable the first output tray to be sufficiently rotated to expose one or more access doors, to expose other printer features, or to selectively disable said collator, wherein the first output tray and the second output tray are configured to move along the curved surface between a first position in which the first output tray and the second output tray extend in a first plane and a second position in which the first output tray and the second output tray extend in a second plane perpendicular to the first plane so as to expose one or more access doors, to expose other printer features, or to selectively disable the collator.

* * * * *

UNITED STATES PATENT AND TRADEMARK OFFICE

CERTIFICATE OF CORRECTION

PATENT NO. : 7,093,992 B2
APPLICATION NO. : 10/659866
DATED : August 22, 2006
INVENTOR(S) : Sarah E Zeller et al.

It is certified that error appears in the above-identified patent and that said Letters Patent is hereby corrected as shown below:

In column 9, line 45, in Claim 18, delete “actuar” and insert -- actuator --, therefor.

In column 9, line 61, in Claim 19, after “compartments” insert -- directly --.

In column 9, line 63, in Claim 19, delete “actuar” and insert -- actuator --, therefor.

In column 9, line 63, in Claim 19, after “configured” insert -- to --.

Signed and Sealed this

Twenty-fourth Day of February, 2009

JOHN DOLL
*Acting Director of the United States Patent and Trademark Office*